US006913541B2

(12) United States Patent
Chen

(10) Patent No.: US 6,913,541 B2
(45) Date of Patent: Jul. 5, 2005

(54) GOLF PUTTING TRAINING APPARATUS

(76) Inventor: David Chen, 9F-1, No. 629, Sec. 1, Chung Teh Road, Taichung (TW)

( * ) Notice: Subject to any disclaimer, the term of this patent is extended or adjusted under 35 U.S.C. 154(b) by 222 days.

(21) Appl. No.: 10/108,552

(22) Filed: Mar. 29, 2002

(65) Prior Publication Data

US 2003/0186753 A1 Oct. 2, 2003

(51) Int. Cl.[7] ..... A63B 69/36
(52) U.S. Cl. ..... 473/161
(58) Field of Search ..... 473/151, 157, 473/158, 160, 161–163, 197, 279

(56) References Cited

U.S. PATENT DOCUMENTS 4,247,112 A * 1/1981 Del Raso ..... 473/153
5,087,045 A * 2/1992 Kim ..... 473/152
5,100,145 A * 3/1992 Kim ..... 473/160
5,301,947 A * 4/1994 Kim ..... 473/153
5,718,639 A * 2/1998 Bouton ..... 473/151
5,733,200 A * 3/1998 Kim ..... 473/161
5,855,522 A * 1/1999 Bevan ..... 473/160
2002/0128084 A1 * 9/2002 Lee et al. ..... 473/132

* cited by examiner

*Primary Examiner*—Derris H. Banks
*Assistant Examiner*—Alex F. R. P. Rada, II
(74) *Attorney, Agent, or Firm*—Browdy and Neimark, P.L.L.C.

(57) ABSTRACT

A golf putting training apparatus comprises a base, which has a ball hole, a detect device disposed in the ball hole, a back tunnel, a return tunnel and a connect tunnel communicating the ball hole with the return tunnel. Three motor-driven elevating assemblies are disposed at the base. Each elevating assembly has an elevating device to be driven to move upwards and move downwards. The elevating assemblies are not arranged in a line for the top ends of the elevating devices can construct a face. A movable surface has a ball aperture thereon. The top ends of the elevating devices of the elevating assemblies connect movable surface for drive the movable surface to be bent to change the slope thereof. A interface unit has a display portion thereon for displaying corresponding information and a setting portion thereon for manual operating, and a control unit is for controlling the elevating devices of the elevating assemblies to move.

19 Claims, 10 Drawing Sheets

GOLF PUTTING TRAINING APPARATUS

FIELD OF THE INVENTION

The present invention relates to a golf relative tool, and more particularly to a golf putting training apparatus.

BACKGROUND OF THE INVENTION

In the prior art, a conventional golf putting training apparatus provided a base, a inclined path in front of the base and a goal on the base. The slopes of the base and the path are fixed in the prior art. User will get bore after a long time of putting. The putting skill will not improve after user get use to the training apparatus.

Although there were some golf putting training apparatus providing the function of changing the slope, but the mechanism of changing slope needs manual operating or needs to switch the whole set of the path. The procedure of changing slope is very complex. It is hard to change the slope of the training apparatus whatever user wants in training.

SUMMARY OF THE INVENTION

The primary objective of the present invention is to provide a golf putting training apparatus, which can change the slope by motor-driven to provide a convenient way to change the slope.

The second objective of the present invention is to provide a golf putting training apparatus, which provide a programmable way to change the slope.

According to the objective of the present invention, a golf putting training apparatus comprises a base. At least three elevating assemblies disposed at the base. Each elevating assembly has an elevating device to be driven to move upwards and move downwards. The elevating assemblies are not arranged in a line for the top ends of the elevating devices can construct a face. A movable surface has a ball aperture thereon. The top ends of the elevating devices of the elevating assemblies connect movable surface for drive the movable surface to be bent to change the slope thereof, and a control unit for controlling the elevating devices of the elevating assemblies to move.

DETAIL DESCRIPTION OF THE INVENTION

Figure 1:
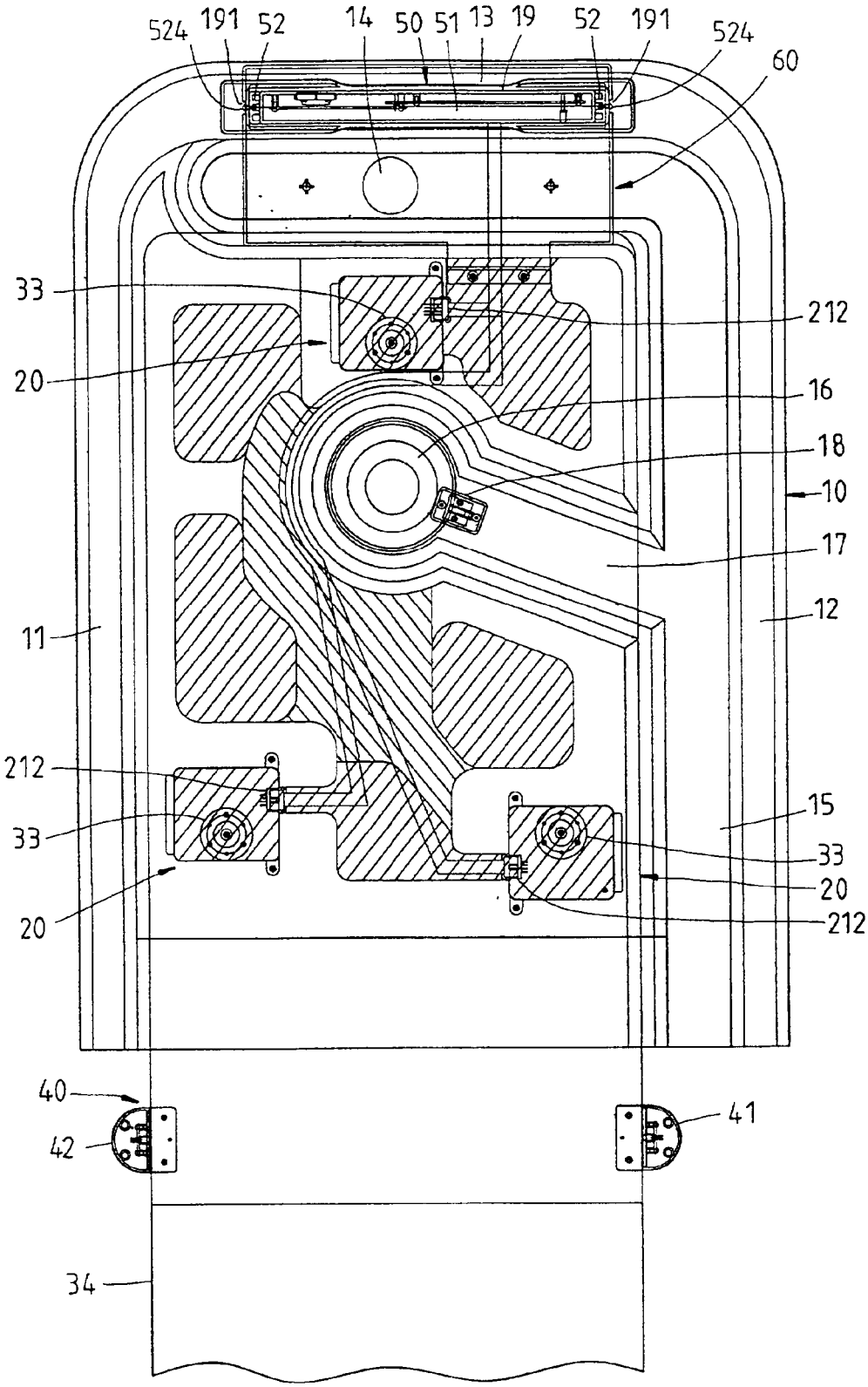
FIG. 1 is a top view of a prefer embodiment of the present invention.
Figure 2:
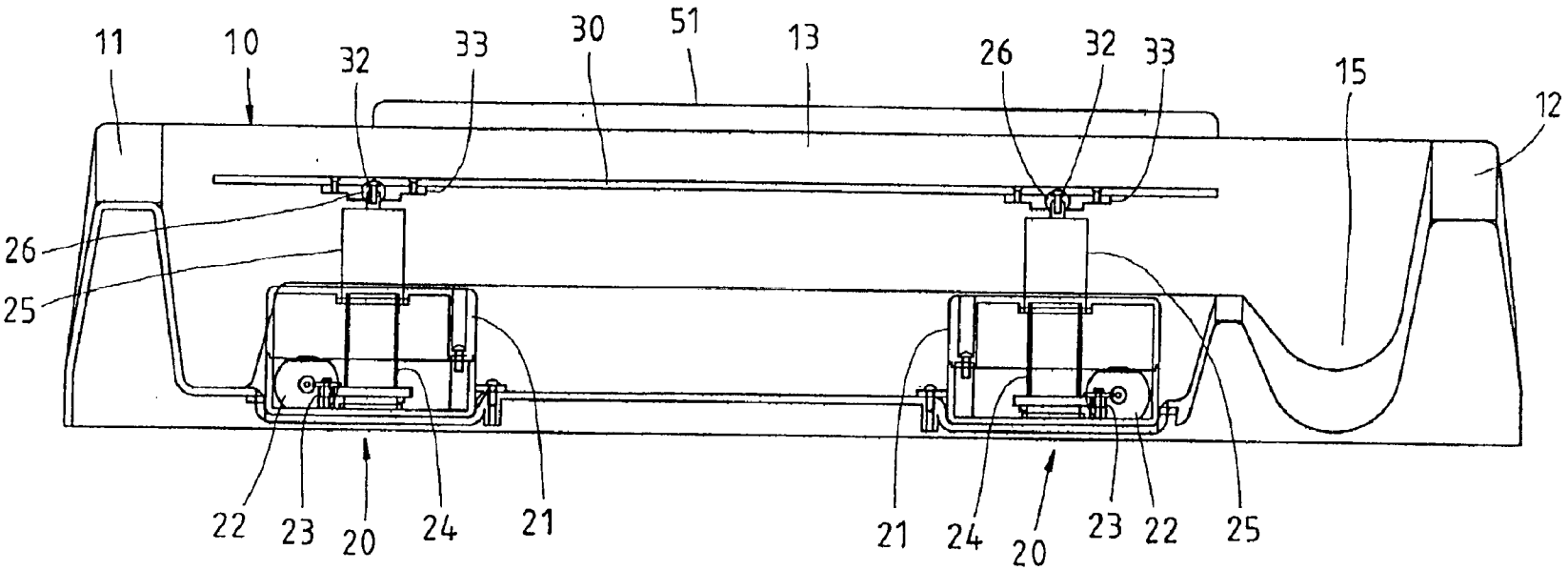
FIG. 2 is a front view in part of the prefer embodiment of the present invention.
Figure 3:
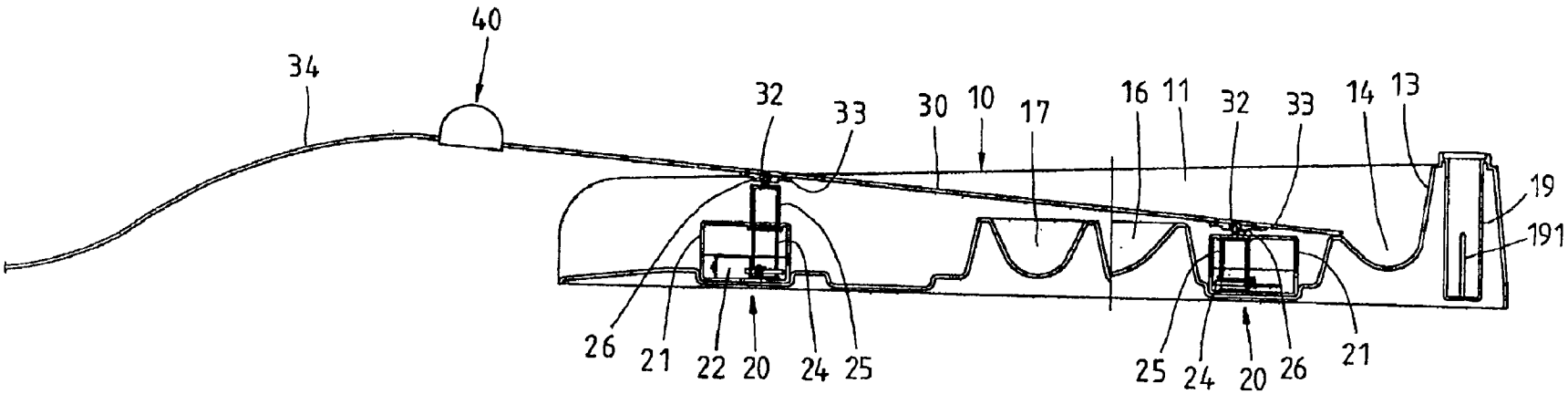
FIG. 3 is a lateral view of the prefer embodiment of the present invention.
Figure 4:
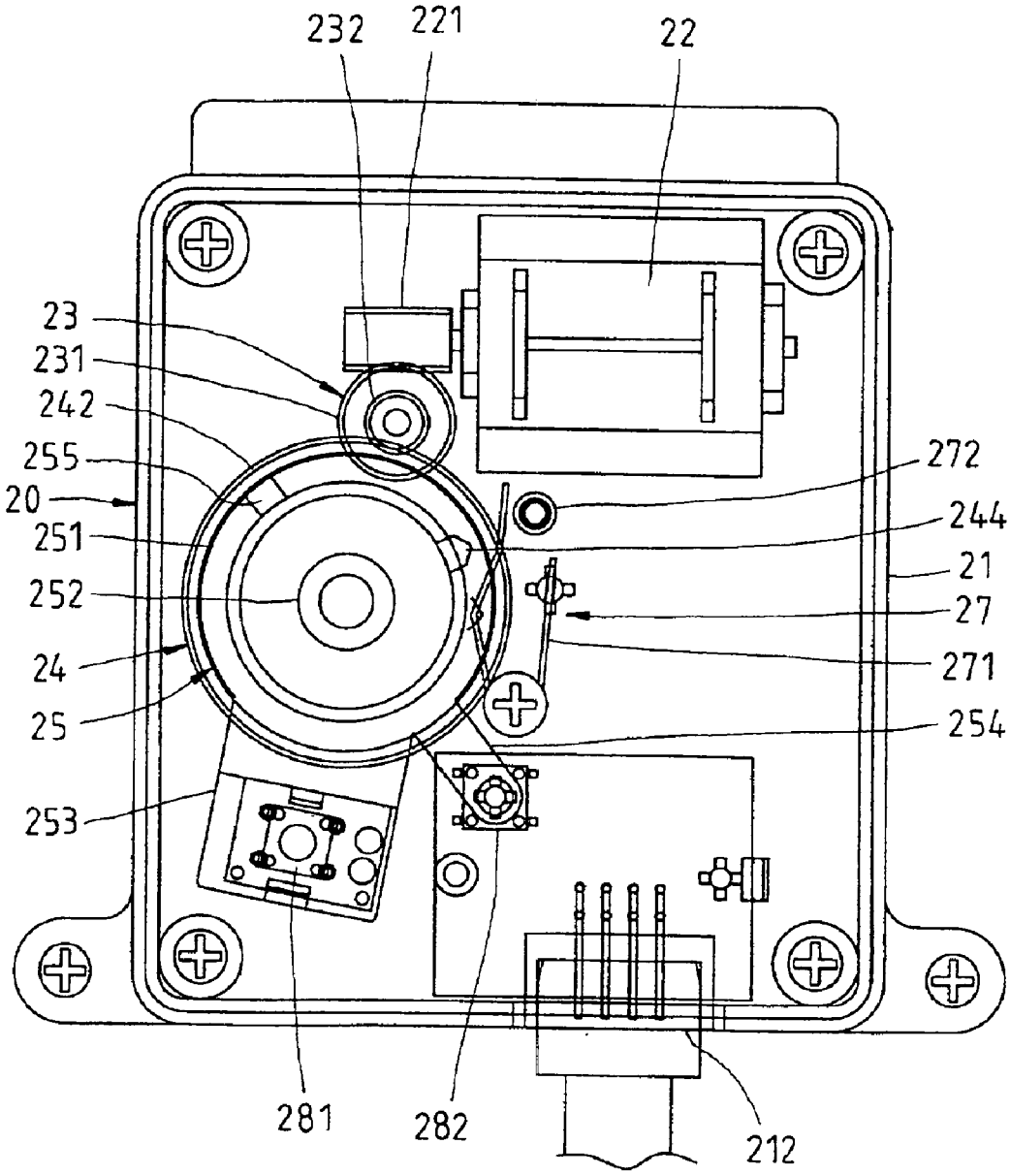
FIG. 4 is a top view of an elevating assembly of the prefer embodiment of the present invention.

Please refer to FIGS. from FIG. 1 to FIG. 3, a golf putting training apparatus of the prefer embodiment of the present invention comprises a base 10, three elevating assemblies 20, a movable surface 30, an optical sensor 40, a interface unit 50 and a control unit 60.

Figure 11:
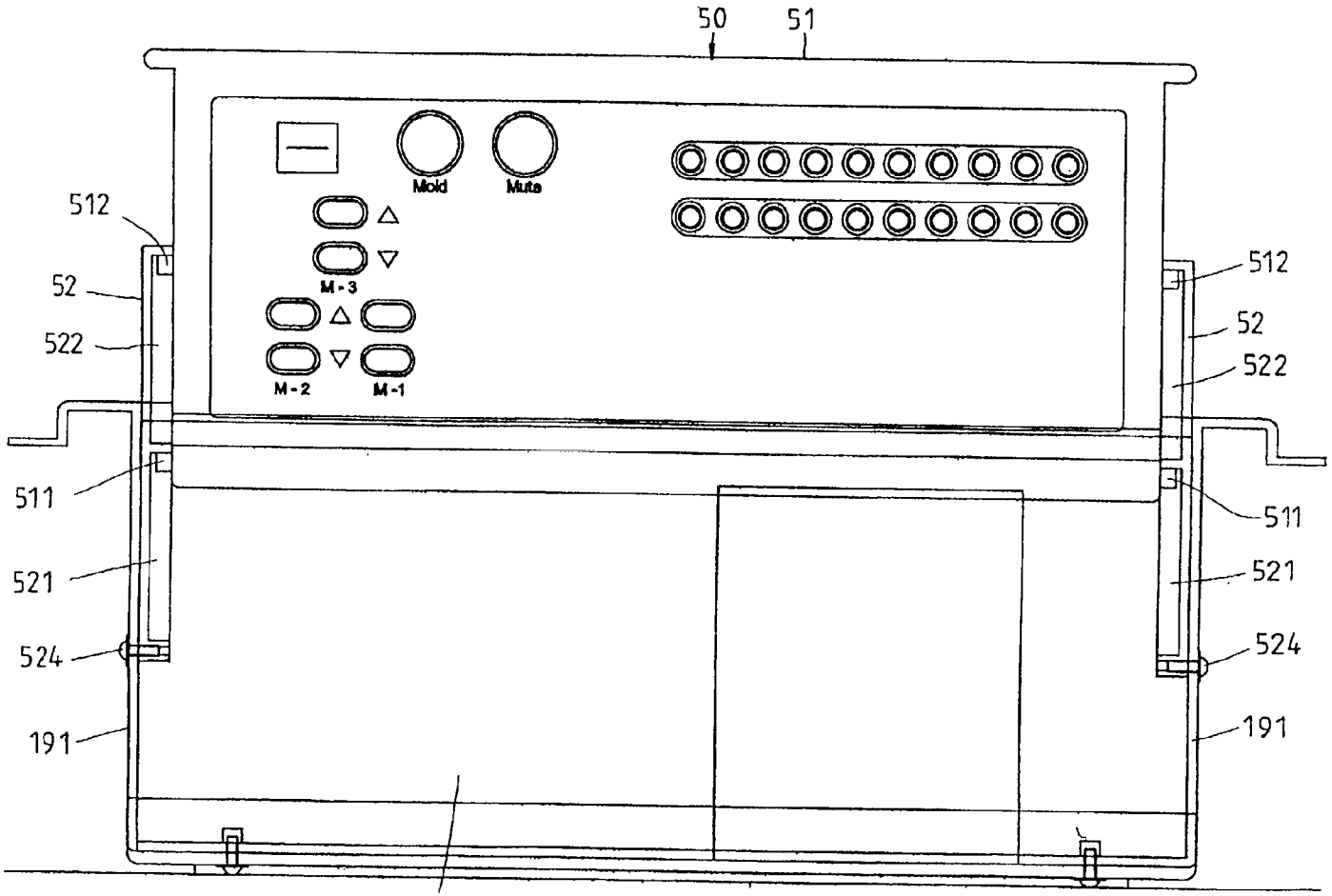
Figure 12:
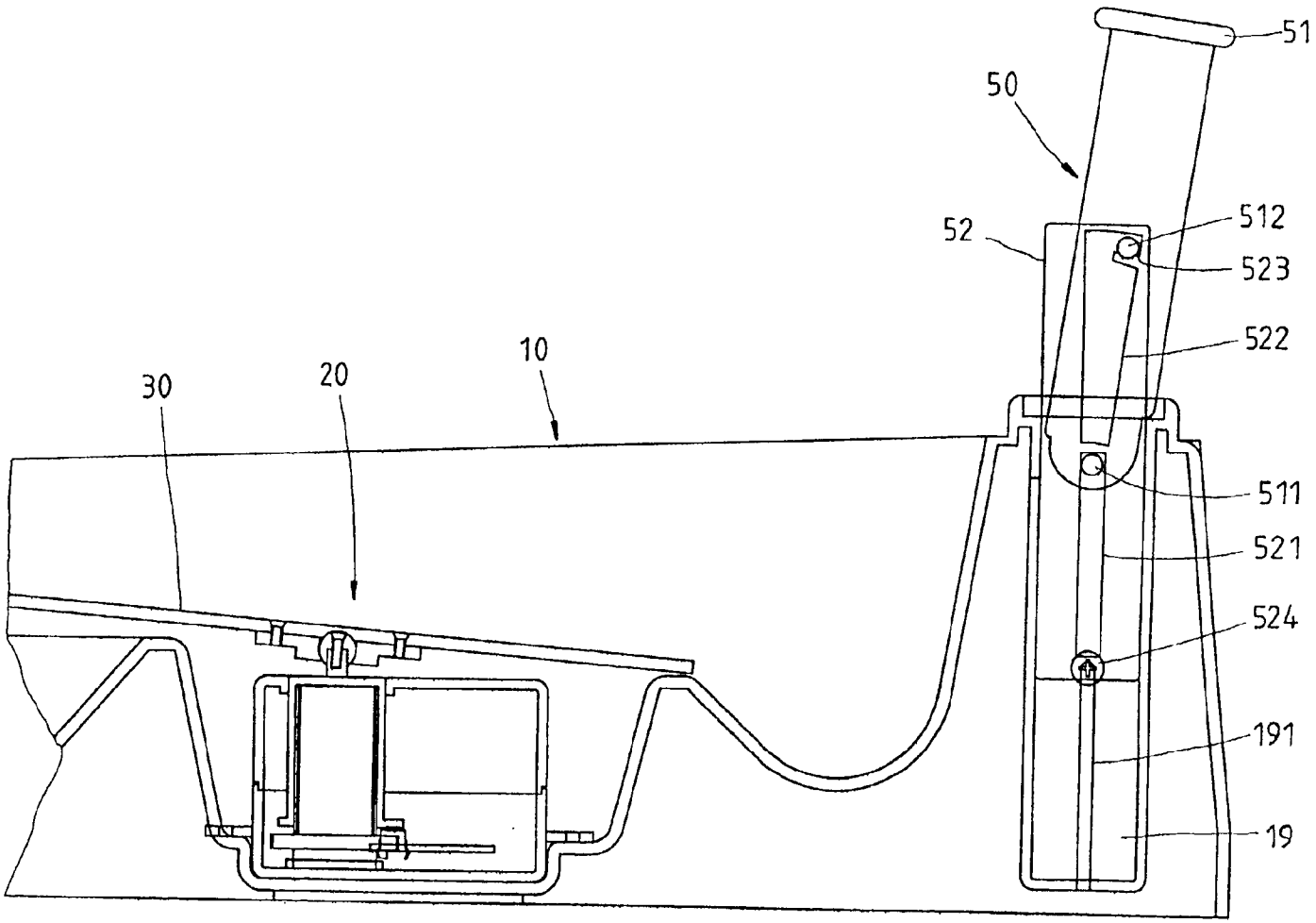
FIG. 12 is a lateral view of an interface unit of the prefer embodiment of the present invention, showing the case being totally exploded and lay back.

The base 10 is a rectangular element for putting on ground. The base 10 has three sidewalls 11, 12 and 13 at back side and two lateral sides respectively. The base 10 further has a back tunnel 14 beside sidewall 13 at the back side and a return tunnel 15 beside the sidewall 12 at right side. The back tunnel 14 communicates with the return tunnel 15 at right end thereof. The back tunnel 14 is inclined downwards from left side to right side. The return tunnel 15 is inclined downwards from the end communicating with the back tunnel 14 to the opposite end. The return tunnel 15 is opening at the front side of the base 10. The base 10 has a ball hole 16 in front of the back tunnel 14. A connect tunnel 17 communicates the ball hole 16 to the return tunnel 15, which is inclined downwards from the end communicating with the ball hole 16 to the end of communicating with the return tunnel 15. A detect device 18 is disposed at the bottom side of the ball hole 16 to detect whether a ball ran into the ball hole 16. The detect device 18 is a micro-switch in this prefer embodiment, but it also can replaced by optical sensor and the like. The base 10 has a case slot 19 at the top end of the sidewall 13 at back side, in which has two lock slots 191 at the lateral walls respectively as shown in FIG. 11 and FIG. 12.

The elevating assemblies 20 are disposed on the base 10, one of which positions at back side of the ball hole 16 and the other two of which position at front side of the base 10. Each of the elevating assemblies 20 comprises the following elements.

A case body 21 is secured on the base 10, which has a round hole 211 at topside thereof and a recess 213 in the hole 211. The case body 21 has an electric socket 212 at a lateral side thereof.

A motor 22 is secured in the case body 21, which has a worm shaft 221 fastening to the output shaft of the motor 22.

A transmit device 23 has a worm portion 231 and a gear portion 232 along same axis. The transmit device 23 is pivoted in the case body 21 with the worm portion 231 thereof meshed with the worm shaft 221 of the motor 22.

A rotatable device 24 has a screw portion 241, a gear potion 242 and a shaft portion 243. The shaft portion has a flange 244 at out surface thereof. The rotatable device 24 is disposed in the case body 21 with an end of the shaft portion 243 pivoted at a side of the case body 21 and the gear portion 242 meshed with the gear portion 232 of the transmit device 24.

An elevating device 25 has a screw tube 251. The screw tube 251 has an opening end and a closed end. The screw tube 251 has a second tube 252 disposed at the closed end thereof, a switch seat 253 disposed at out surface thereof closing to the opening end and an arm 254 disposed at the opposite side from the switch seat 253. The screw tube 251 of the elevating device 25 is inserted into the hole 211 of the case body 21 and meshed with the screw potion 241 of the rotatable device 24. The screw tube 251 has a rib 255 at out surface thereof to engage to the recess 213 in the hole 211 of the case body 21 for the screw tube 251 only can slide along the axial direction thereof but can not rotate.

A ball head 26 is secured the distal end of the second tube 252 of the elevating device 25.

A counter 27 has a metal elastic member 271 and a metal terminal 272. The elastic member is a torsional spring in this prefer embodiment disposed at the case body 21 beside the rotatable device 24. The elastic member 271 has an end thereof fastening to the case body 21 and the other end thereof can be driven by the flange 244 the rotatable device 24 to move inward. The terminal 272 is disposed in the case body 21 at bottom side thereof. While the elastic member 271 is driven to move inward, it will touch the terminal 272 to start a counter circuit (not shown) once.

A first touch switch 281 is disposed on the switch seat 253 of the elevating device 25. The first touch switch 281 will touch the top wall of the case body 21 to start it while the elevating device 25 moves upward.

A second touch switch 282 is disposed in the case body 21 at bottom wall thereof positioning below the arm 254 of the elevating device 25. The second touch switch 282 is started when the elevating device 25 moves downward.

The motor 22, the counter 27 and the first and the second touch switches 281 and 282 of the elevating assembly 20 conducts to a circuit (not shown), and the circuit conducts to the electric socket 212 on the lateral side of the case body 21.

The movable surface 30 is a rectangular board in this prefer embodiment, which has a ball aperture 31 on topside thereof and three recesses 32 on bottom side thereof corresponding to the elevating assemblies 20 respectively. Each recess 32 secures a seat 33 therein. Each seat 33 has a ball slot 331, which has a bigger opening on the topside thereof corresponding to the opening end of the recess 32. The ball heads 26 of the elevating devices 25 of the elevating assemblies 20 joint the ball slots 331 of the movable surface 30 respective to make the movable surface 30 can free incline relative to the elevating devices 25 in a predetermined angle range. In other words, the movable surface 30 is covered on the topsides of the elevating assemblies 30 with the left end thereof beside the sidewall 11 of the base 10, the back end and the right end beside the back tunnel 14, the return tunnel 15 and the front end thereof over the front end of the base 10. The ball aperture 31 of the movable surface 30 corresponds to the ball hole 16 of the base 10. The rigid movable surface 30 fastens a soft slope surface 34 at front side thereof to touch the ground as shown in FIG. 3.

The optical sensor 40 has an infrared ray emitter 41 and an infrared ray receiver 42 secured at lateral sides of the movable surface 30 respectively closing to the front end thereof. The emitter 41 can emit infrared ray to the receiver 42. If the infrared ray is cut by an object, such as a golf ball, the optical sensor 40 will provide a signal representing a ball is running through the movable surface 30. The optical sensor 40 can be replaced by the other types of the sensors having same function, such as provides the emitter and the receiver at the same side and provides a reflect wall at the opposite side to reflect the infrared ray.

The interface unit 50 is to display information, broadcast audio messages and manual setting. Please refer to FIGS. from FIG. 9 to FIG. 11, the interface unit 50 comprises a case 51 inserted into the case slot 19 on the sidewall 13 at the back side of the base 10. Each lateral end of the case 51 is disposed a first pin 511, a second pin 512 and a slidable device 52 thereon respectively. Each slidable device 52 has a first guiding slot 521 and a second guiding slot 522 at interior side thereof. The second guiding slot 522 further has a lock recess 523 therein. The first and the second pins 511 and 512 of the case 51 engage to the first and the second guiding slots 521 and 522 of the slidable devices 52 respectively with lock pins 524 disposed on the second pins 523 to be inserted into the lock recesses 523 in the second guiding slots 522 respectively for securing the slidable devices 52 on the case 51. The case 51 disposes a speaker (not shown) therein for broadcasting music and voice messages. The case 51 further has a display portion 53 and a setting portion 54 on the front side thereof. The display portion 53 is twenty light-emitting diodes (LEDs) arranged as two rows on the case 10. The setting portion 54 has three sets of elevating setting buttons 541, each set of which has an up button and a down button, a mode setting button 542 and a mute button 543. Three sets of the elevating setting buttons 541 are for controlling the three elevating assemblies 20 to move respectively.

The control unit 60 is disposed at the back side of the base 10, which is constructed from microprocessors and a circuit. The control unit 60 conducts to the interface unit 50, the elevating assemblies 20 (at the socket 212), the optical sensor 40 and the detect device 18 in the ball hole 16 of the base 10 to integrate the actions of the elements of the putting train apparatus of the present invention. Give an example, user operates the setting unit 50 to control the elevating assemblies 20 to move upwards or to move downwards respectively, actually he/she operates the control unit 60 to drive the motors 22 of each elevating assembly 20 respectively to turn to a predetermined direction and a predetermined angle. The signals provided from the optical sensor 40 and the detect device 18 are processed in the control unit 60 for showing the corresponding information on the display portion 53 of the interface unit 50.

Hereunder I will take one elevating assembly 20 to describe how it works.

Figure 5:
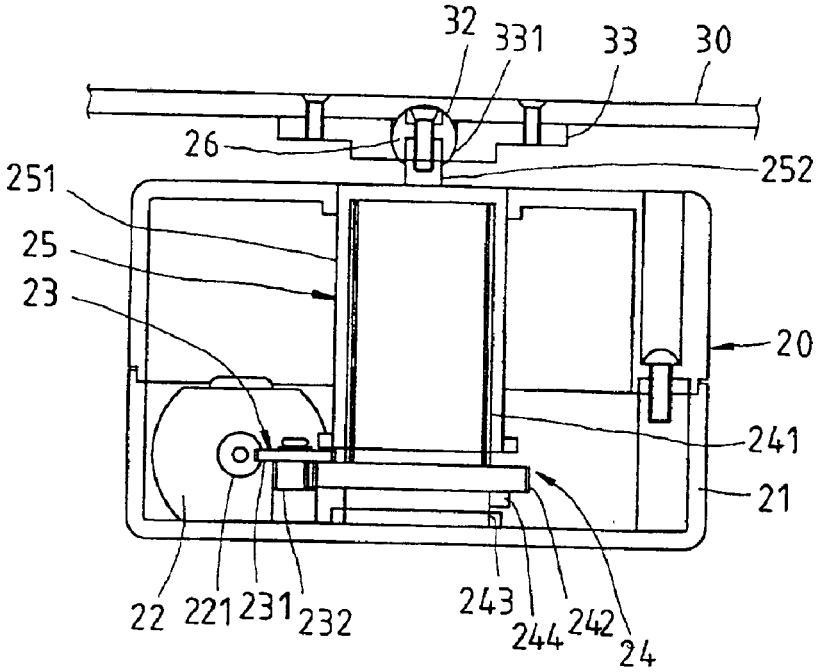
FIG. 5 is a lateral view of the elevating assembly, showing the elevating assembly moving to the bottom dead point.
Figure 6:
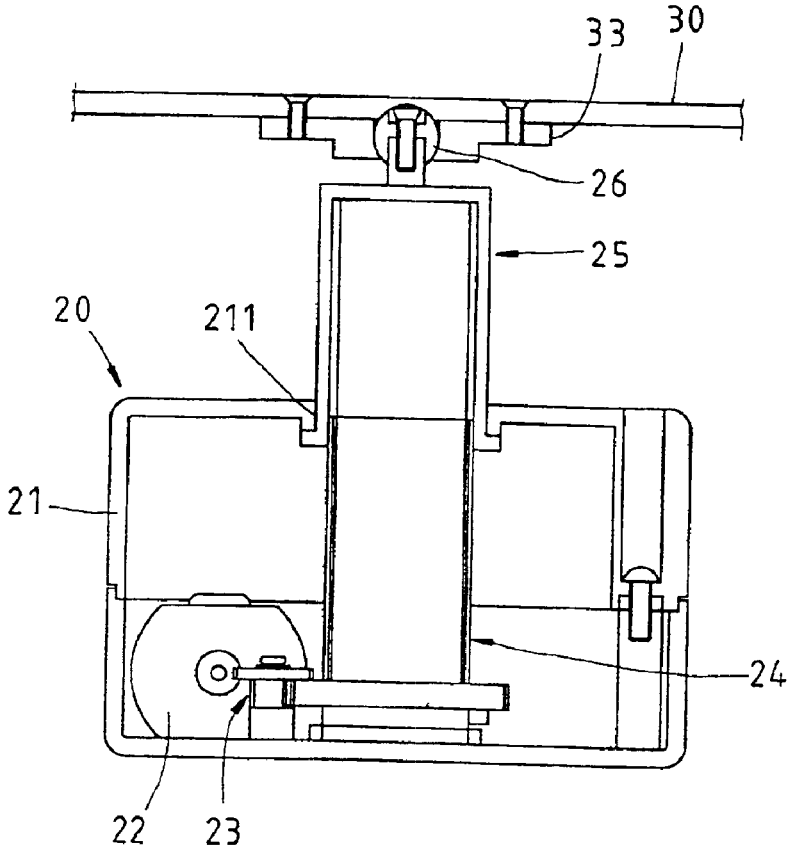
FIG. 6 is a lateral view of the elevating assembly, showing the elevating assembly moving to the top dead point.
Figure 7:
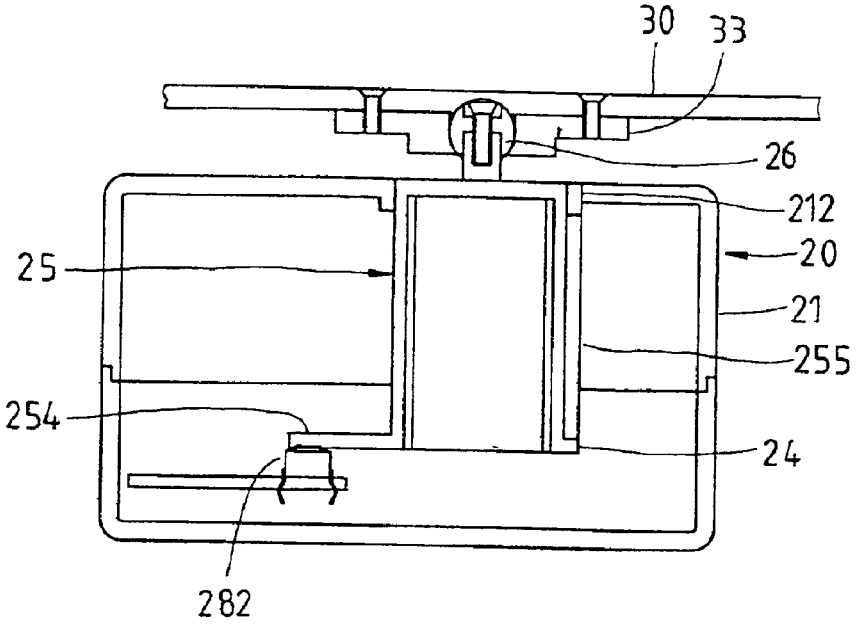
FIG. 7 is another lateral view of the elevating assembly in FIG. 5.

When the control unit 60 commands the motor 22 of the elevating assembly 20 to turn, the rotatable device 24 will be driven to rotate first via the transmit device 23. The rotatable device 24 will drive the elevating device 25 to move upwards or to move downwards as shown in FIG. 5 and FIG. 6 respectively. The ball head 26 at the top end of the elevating device 25 joints the seat 33 at the bottom side of the movable surface 30, which works like an universal joint, to make movable surface 30 being bent to change the slope of the movable surface 30 when the elevating devices 25 of the elevating assemblies 20 are driven to move upwards or to move downwards. Thus, even there is only one elevating device 25 of the elevating assembly 20 is driven to move upwards or to move downwards but the other two elevating assemblies 20 don't, the movable surface 30 will change the slope without any interference. The front end of the soft slope surface 34 extends to the ground, no matter how is the slope of the movable surface 30 changed.

Figure 8:
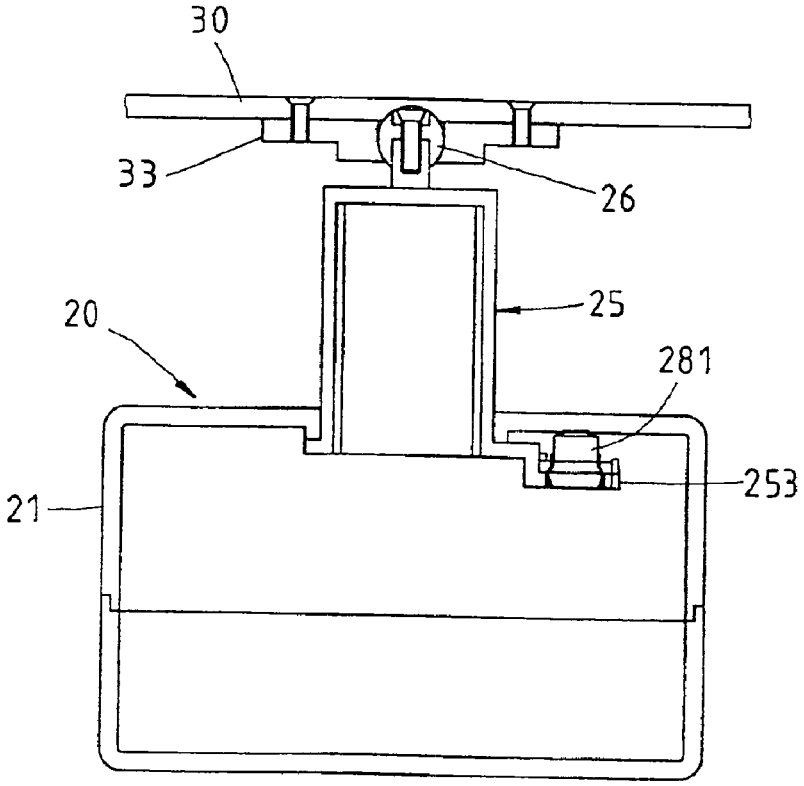
FIG. 8 is another lateral view of the elevating assembly in FIG. 6.
Figure 9:
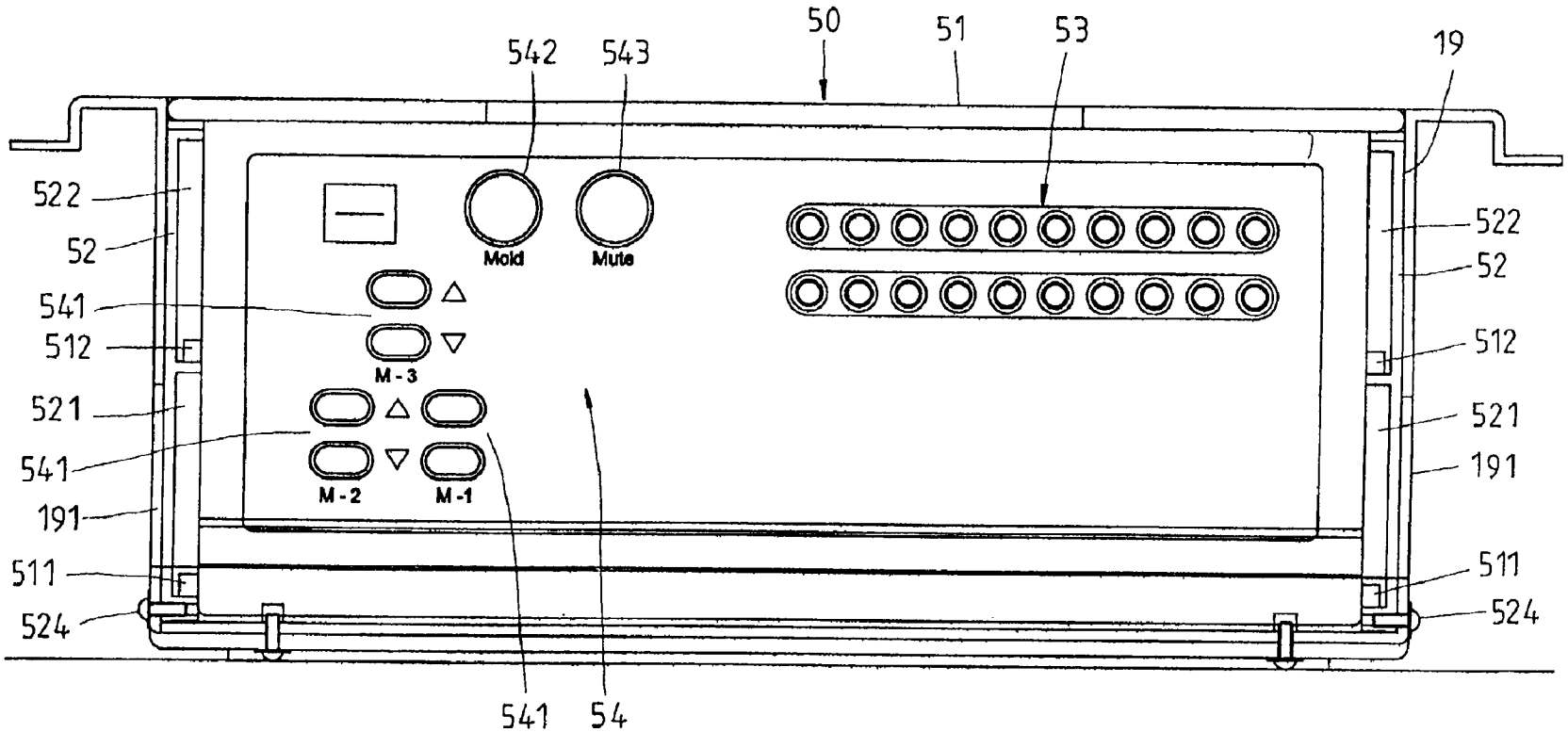
FIG. 9 to FIG. 11 are front views of the prefer embodiment of the present invention, respectively showing a case being totally received in, half exploded and totally exploded from the case slot.

Please refer to FIG. 8, while the elevating device 25 of the elevating assembly 25 is driven to move upwards and make the first touch switch 281 being against the top wall of the case 21, which means the elevating device 25 moves to the top dead point. Or the elevating device 25 of the elevating assembly 25 is driven to move downwards and make the second touch switch 282 being against the bottom wall of the case 21 as shown in FIG. 9, which means the elevating device 25 moves to the bottom dead point. The flange 244 of the rotatable device 24 will drive the elastic member 271 of the counter 27 touching the terminal 272, while the rotatable device 24 is driven to rotate a circle. That will make the counter 27 counting once. The actions of the touch switches 281 and 282 and the counter 27 can provide signals to the control unit 60 to precisely control the motor 22 to start and to stop. Of course, a stepper motor can be produced to the present invention to provide a precisely controlling of the elevating assembly.

I have to mention here, the present invention provides three elevating assemblies 20 to support the movable surface 30 at three points to make the movable surface 30 having an inclined flat portion within the three elevating assemblies 20. The movable surface 30 also can be made from flexible board, such as rubber board or thin metal board. The amounts of the elevating assemblies 20 also can be provided as four or more to make the movable surface 30 having a variety of slopes.

If there is a ball running through the slope surface 34 and arriving the movable surface 30 on the base 10, the optical sensor 40 will detect the ball, which means user putting once, and transmit a signal to the control unit 60. The control unit 60 now will command the display portion 53 of the interface unit 50 showing the corresponding message, such as light a LED of the first row.

If a ball runs to the movable surface 30 but did not run into the ball hole 16 and did not run into the back tunnel 14 or the return tunnel 15, the ball will run back to make the optical sensor 40 detecting the ball again. This will make a false detecting of the optical sensor 40. To prevent this situation, the optical sensor 40 can be set to a delay detecting mode, which means the optical sensor 40 will detect nothing within a predetermined period after first time detecting. It also can be done by providing a second optical sensor (not shown in FIG.) to identify whether the ball is running from the ground to the movable surface 30 or is running back to the ground.

If a ball runs to the movable surface 30 and runs into the ball hole 16, the ball will run back to the ground via the connect tunnel 17 and the return tunnel 15 to run back to the user. The detect device 19 will detect the ball at this time to give the control unit 60 a signal and show the corresponding information on the display portion 53 of the interface unit 50 showing the corresponding message, such as light a LED of the second row.

If a ball runs to the movable surface 30 but missing the ball hole 16 and runs into the back tunnel 14, the ball will runs back to the ground via the return tunnel 15. The ball also may run into the return tunnel 15 directly, it will run back to the ground too.

Figure 10:
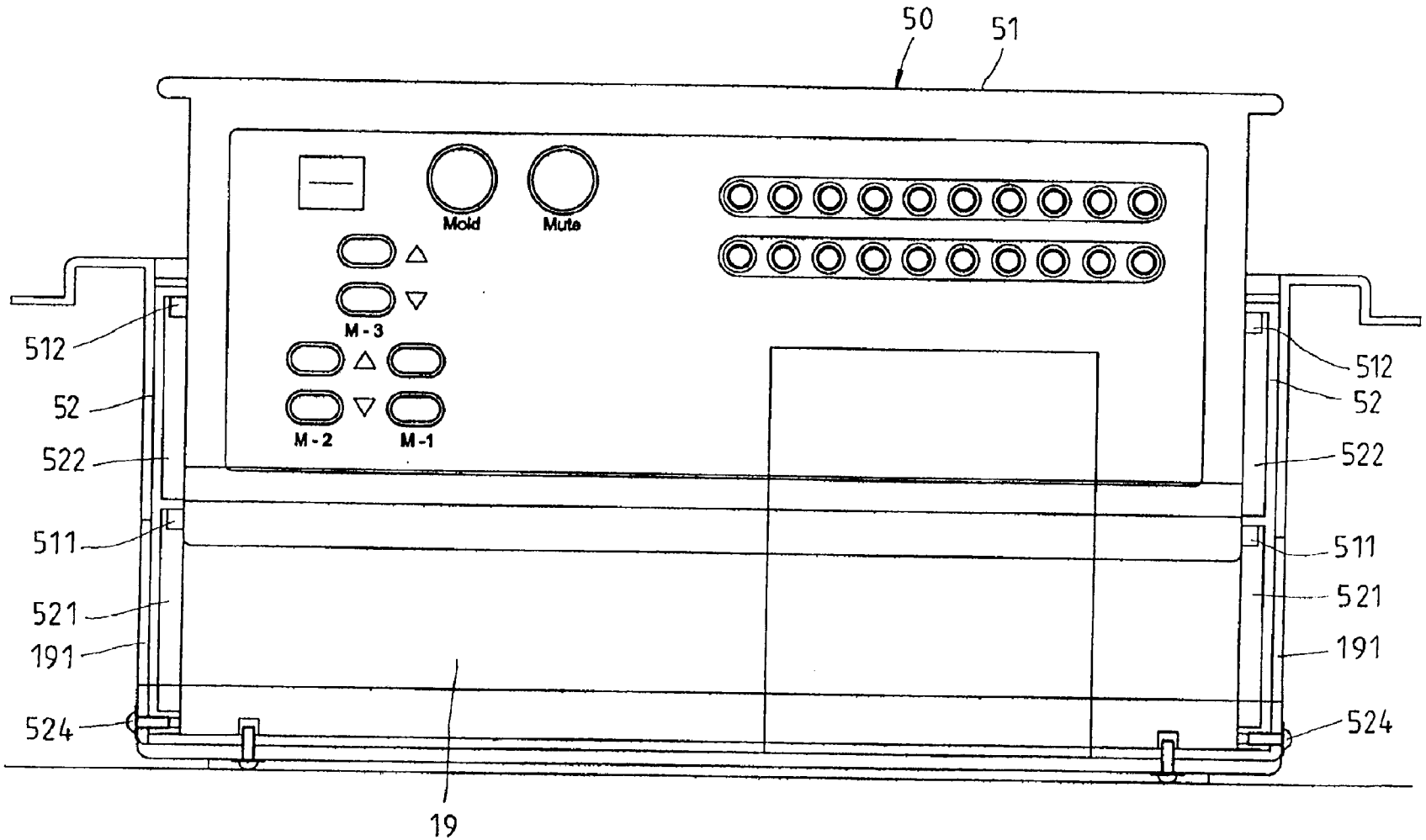

Please refer to FIG. 9, the case 51 of the interface unit 50 can be totally received in the case slot 17. At this time, the slidable devices 52 of the case 51 will be totally received in the case slot 19 too with the first and the second pins 511 and 512 on the lateral sides of the case 51 being against the bottom ends of the first and the second guiding slots 521 and 522 of the slidable devices 52 respectively and the lock pins 524 of the slidable devices 52 being locked at the bottom end of the lock slots 191 in the case slots 19 respectively. When pull the case 51 out from the case slot 19, the slidable devices 52 will keep still first and the first and the second pins 511 and 512 will slide upwards and be against the top ends of the first and the second guiding slots 521 and 522 respectively to make the case 51 only can be pulled out half as shown in FIG. 10. After that, the slidable devices 52 are driven to move with the case 51 to the top dead point thereof as shown in FIG. 11. At this time, the total case 51 is exposed from the sidewall 13 at the back side of the base 10 and half of the slidable devices 52 will be exposed too. The lock pins 524 now are stopped at the top end of the lock slots 191 respectively. After the case 51 is pulled out totally, user can push the case 51 to lie back to make the second pins 512 thereof running into the lock recesses 523 on the topside of the second guiding slots 522 respectively to keep the case 51 in this angle as shown in FIG. 12. That will make user can read the messages on the display portion 53 of the case 51 easily.

The circuit conduction and the circuit control of the prefer embodiment described above are not the main characters of the present invention, so I will not describe the detail here.

The operating modes and the characters of the golf putting training apparatus of the present invention are described hereunder:

1. User can change the slopes of the movable surface 30 as he/she wants via operating the elevating setting buttons 541 on the interface unit 50 for user can train the putting skill at a variety of slopes.

2. User also can operate the mode setting button 542 on the interface unit 50 to make the movable surface 30 to change the slope after a predetermined times of putting, such as user can set the movable surface 30 to change the slope automatically after ten times of putting or ten time of putting to the ball hole 16.

3. The display portion 53 of the interface unit 50 will show the information of training, such as times of putting and times of putting into the ball hole 16.

4. The training apparatus of the present invention can be set to an operation mode, which means user has to complete one operation, such as putting ten balls into the ball hole 16 in a predetermined slope of the movable surface 30, then he/she can go to the next operation (with different slope). The degrees of difficulties of the operations are difficult more and more.

5. The speaker (not shown) in the case 51 can broadcast music or voice messages to encourage user or to speak out the messages corresponding to the present operating mode. The mute button 543 is to close the broadcast function.

In conclusion, the golf putting training apparatus of the present invention provides a simpler and a faster way to adjust the slope of the movable surface for user can change the slope by himself/herself. It further provides a variety of setting and selecting by programming to change the slope automatically. Thus, the golf putting training apparatus of the present invention can improve user's putting skill greatly after several times of training.

What is claimed is:

1. A golf putting training apparatus, comprising:

a base;

at least three elevating assemblies disposed at said base, each of said elevating assemblies having an elevating device respectively to be driven to move upwards and move downwards, said elevating assemblies not arranged in a line such that the top ends of said elevating devices construct a face;

a movable surface having a ball aperture thereon, the top ends of said elevating devices of said elevating assemblies connecting said movable surface to drive said movable surface to change the slope thereof, a control unit for controlling said elevating devices of said elevating assemblies to move; and wherein each of said elavating assemblies has a first touch switch and a second touch switch, each of which conducting to said control unit; said first touch switch will be started while said elavating device moves to top dead point and said second touch switch will be started while said elevating device moves to bottom dead point.

2. The golf putting training apparatus as defined in claim 1, wherein said control unit controls said elevating assemblies by programming.

3. The golf putting training apparatus as defined in claim 1, wherein further comprises an interface unit, which has a display portion for displaying message and a setting portion for manual operating.

4. The golf putting training apparatus as defined in claim 3, wherein said base has a case slot at back side thereof, which has two lock slots respectively at lateral sidewalls therein; said interface unit having a case, each lateral side of which having a first pin and a second pin thereon respectively, two slidable devices, each of which having a first guiding slot and a second guiding slot at each lateral side thereof respectively; each second guiding slot having a lock recess therein; said slidable devices provided at the lateral sides of said case respectively with said first pins engaging said first guiding slots and said second pins engaging said second guiding slots respectively; each slidable device having a lock pin inserted into said lock slots of said case slot respectively; said display portion and said setting portion being disposed on the front side of said case.

5. The golf putting training apparatus as defined in claim 3, wherein said setting portion of said interface unit has elevating setting buttons for controlling said elevating devices of said elevating assemblies to move respectively.

6. The golf putting training apparatus as defined in claim 3, wherein said display portion of said interface unit has light-emitting diodes (LEDs) arranged as two rows; the first row of said light-emitting diodes showing the times of putting and the second row of light-emitting diodes showing the times of putting into ball hole.

7. The golf putting training apparatus as defined in claim 3, wherein interface unit disposes a speaker therein for broadcasting audio message.

8. The golf putting training apparatus as defined in claim 1, wherein further comprises an optical sensor disposed at the front side of said movable surface for detecting whether a ball runs to said movable surface; said optical sensor conducting to said control unit.

9. The golf putting training apparatus as defined in claim 1, wherein further comprises two optical sensors disposed at the front side of said movable surface for detecting whether a ball runs to said movable surface and the running direction of the ball, said optical sensors conducting to said control unit.

10. The golf putting training apparatus as defined in claim 1, wherein each elevating assembly further has a motor and a rotatable device respectively, wherein said motor conducts to said control unit, and rotatable device can be driven to rotate by said motor; said rotatable device having a screw portion at topside thereof; said elevating device having a screw tube to mesh with said screw portion of said rotatable device; said elevating device being disposed at the bottom side of said movable surface but can not be turned.

11. The golf putting training apparatus as defined in claim 10, wherein said rotatable device has a flange on the out surface thereof, an elastic member being disposed beside said rotatable having an end thereof fixed and the other end thereof movable, a terminal being disposed beside the movable end of said elastic member; said flange of said rotatable device pushing the movable end of said elastic member in rotating to drive said elastic member touching said terminal; said elastic member and said terminal conducting to a counter circuit; said counter circuit counting once while said elastic member touches said terminal.

12. The golf putting training apparatus as defined in claim 1, wherein said movable surface disposes at least three seats at bottom side thereof, each of which having a ball recess; each of said elevating device of said elevating assembly having a ball head jointing said ball recess of said seat respectively.

13. The golf putting training apparatus as defined in claim 1, wherein said base has a back tunnel at back side thereof, a return tunnel at a lateral side thereof communicating said back tunnel; said back tunnel being inclined downwards to the end communicating with said return tunnel; said return tunnel being inclined downwards from the end communicating with said back tunnel to the opposite end thereof; said return tunnel extending to the front end of said base; said base further having a ball hole corresponding to said ball aperture of said movable surface and a connect tunnel having an end communicating with said ball hole and the other end communicating with said return tunnel; said connect tunnel being inclined downwards from the end thereof communicating with said ball hole to the end thereof communicating with said return tunnel.

14. The golf putting training apparatus as defined in claim 1, wherein said base disposes a detect device in said ball hole for detecting whether a ball runs into said ball hole; said detect device conducting to said control unit.

15. The golf putting training apparatus as defined in claim 1, wherein said movable surface has a soft slope surface at front side thereof; the front end of side soft slope surface touching the ground.

16. The golf putting training apparatus as defined in claim 1, wherein said moveable surface is made from a flexible board.

17. A golf putting training apparatus, comprising:

a base;

at least three elevating assemblies disposed at said base, each of said elevating assemblies having an elevating device respectively to be driven to move upwards and move downwards, said elevating assemblies not arranged in a line such that the top ends of said elevating assemblies construct a face;

a movable surface having a hall aperture thereon, the top ends of said elevating devices of said elevating assemblies connecting said movable surface to drive said movable surface to change the slope thereof, a control unit for controlling said elevating devices of said elevating assemblies to move;

wherein said base has a case slot at back side thereof, which has two lock slots respectively at lateral sidewalls therein; said interface unit having a case, each lateral side of which having a first pin and a second pin thereon respectively, two slidable devices, each of which having a first guiding slot and a second guiding slot at each lateral side thereof respectively; each second guiding slot having a lock recess therein; said slidable devices provided at the lateral sides of said case respectively with said first pins engaging said first guiding slots and said second pins engaging said second guiding slots respectively; each slidable device having a lock pin inserted into said lock slots of said case slot respectively; said display portion and said setting portion being disposed on the front side of said case.

18. A golf putting training apparatus, comprising:

a base;

at least three elevating assemblies disposed at said base, each of said elevating assemblies having an elevating device respectively to be driven to move upwards and move downwards, said elevating assemblies not arranged in a line such that the top ends of said elevating assemblies construct a face;

a movable surface having a ball aperture thereon, the top ends of said elevating devices of said elevating assemblies connecting said movable surface to drive said movable surface to change the slope thereof, a control unit for controlling said elevating devices off said elevating assemblies to move;

wherein further comprises an interface unit, which has a display portion for displaying message and a setting portion for manual operating; and wherein said display portion of said interface unit has light-emitting diodes (LEDs) arranged as two rows) the first row of said light-emitting diodes showing the times of putting and the second row of light-emitting diodes showing the times of putting into ball hole.

19. A golf putting training apparatus, comprising:

a base;

at least three elevating assemblies disposed at said base, each of said elevating assemblies having an elevating device respectively to be driven to move upwards and move downwards, said elevating assemblies not arranged in a line such that the top ends of said elevating assemblies construct a face;

a movable surface having a ball aperture thereon, the top ends of said elevating devices of said elevating assemblies connecting said movable surface to drive said movable surface to change the slope thereof, and a control unit for controlling said elevating devices of said elevating assemblies to move;

wherein each elevating assembly further has a motor and a rotatable device respectively, wherein said motor conducts to said control unit, and rotatable device can be driven to rotate by said motor; said rotatable device having a screw portion at topside thereof; said elevating device having a screw tube to mesh with said screw portion of said rotatable device; said elevating device being disposed at the bottom side of said movable surface but can not be turned; and wherein said rotatable device has a flange on the out surface thereof, an elastic member being disposed beside said rotatable having an end thereof fixed and the other end thereof movable, a terminal being disposed beside the movable end of said elastic member; said flange of said rotatable device pushing the movable end of said elastic member in rotating to drive said elastic member touching said terminal; said elastic member and said terminal conducting to a counter circuit; said counter circuit counting once while said elastic member touches said terminal.

* * * * *